US007581452B2

(12) United States Patent
Sandomirsky et al.

(10) Patent No.: US 7,581,452 B2
(45) Date of Patent: Sep. 1, 2009

(54) SYSTEM AND METHOD FOR SOIL STRENGTH MEASUREMENT

(75) Inventors: Sergey Sandomirsky, Irvine, CA (US); Tomasz Jannson, Torrance, CA (US); Paul Shnitser, Irvine, CA (US); Gajendra Savant, Rolling Hills Estates, CA (US)

(73) Assignee: Physical Optics Corporation, Torrance, CA (US)

( * ) Notice: Subject to any disclaimer, the term of this patent is extended or adjusted under 35 U.S.C. 154(b) by 69 days.

(21) Appl. No.: 11/968,867

(22) Filed: Jan. 3, 2008

(65) Prior Publication Data

US 2009/0173147 A1 Jul. 9, 2009

(51) Int. Cl.
*G01N 3/24* (2006.01)

(52) U.S. Cl. ..... 73/841; 73/760

(58) Field of Classification Search ..... 73/760, 73/841

See application file for complete search history.

(56) References Cited

U.S. PATENT DOCUMENTS 4,128,011 A * 12/1978 Savage ..... 73/579
4,942,557 A * 7/1990 Seriff ..... 367/15
5,411,353 A * 5/1995 Taki ..... 405/241
5,444,670 A * 8/1995 Douglas ..... 367/90

OTHER PUBLICATIONS

Planning and Design of Roads, Airfields, and Heliports in the Theater of Operations—Road Design, Field Manual No. 5-430-00-1, Air Force Joint Pamphlet No. 32-8013, Aug. 26, 1994, vol. I, Headquarters, Dept. of the Army, Dept. of the Air Force, Washington, DC.

Patricia M. Sullivan and Alan B. Anderson, A Methodology for Estimating Army Training and Testing Area Carrying Capacity (ATTACC) Vehicle Severity Factors and Local Condition Factors, US Army Corps of Engineers, Engineer Research and Development Center ERDC TR-00-2, Jun. 2000, Champaign, IL 61826-9005.

(Continued)

*Primary Examiner*—Max Noori
(74) *Attorney, Agent, or Firm*—Sheppard Mullin Richter & Hampton LLP

(57) ABSTRACT

A system and method for characterizing soil shear strength from a vehicle, comprises a plurality of sensors mounted on a vehicle and configured to measure distances from the sensors to the soil surface. The sensors comprise a first sensor disposed on the vehicle and configured to measure a first distance between the first sensor and the soil and a second sensor disposed on the vehicle and configure to measure a second distance between a the sensor and a track made in the soil by the vehicle, wherein the first sensor measures the distance at a location before the vehicle wheel travels over that location and the second sensor measures the distance to the bottom of the track made by the wheel. A processing module is communicatively coupled to the sensors and is configured to calculate track depth as a function of the first and second distance measurements; and to derive soil shear strength as a function of the calculated track depth and the vehicle parameters.

32 Claims, 12 Drawing Sheets

OTHER PUBLICATIONS

Jerome B. Johnson, A Statistical Micromechanical Theory of Cone Penetration in Granular Materials, US Army Corps of Engineers, Cold Regions Research and Engineering Laboratory ERDC/CRREL TR-03-3, Feb. 2003.

R.H. Macmillan, The Mechanics of Tractor-Implement Performance, Theory and Worked Examples, A Textbook for Students and Engineers, International Development Technologies Centre, University of Melbourne, Oct. 2002, http://www.eprints.unimelb.edu.au.

Humboldt Materials Testing Solutions, Humboldt Catalog Downloads by Section: Asphalt p. 1-43, Concrete p. 45-89, Soil p. 90-175, General p. 176-219, http://www.humboldmfg.com/section.php.

Transformation of U.S. Army Alaska Final Environmental Impact Statement (FEIS), Updated on May 19, 2005, vol. I, Copyright Colorado State University and U.S. Army Alaska, http://www.cemml.colostate.edu/AlaskaEIS.htm.

Transformation of U.S. Army Alaska Final Environmental Impact Statement (FEIS), Prepared by: Center for Environmental Management of Military Lands, Colorado State University, and Fort Collins, Colorado, 2004, vol. II.

S.K. Pitla and L.G. Wells, Development of an Electro-Mechanical System to Identify & Map Adverse Soil Compaction Using GIS &GPS, American Society of Agricultural and Biological Engineers (ASABE), Paper No. 061056 (An ASABE Meeting Presentation), 2006, pp. 1-11, St. Joseph, Michigan.

* cited by examiner

---------- Continuous ON 9: 43: 10 ( 5/ 31/ 2007) ----------

START X-Coordinate = 3363675.30000728 START Y-Coordinate = 5035725.0987752

| # | Ch.1 | Ch.2 | Ch.3 | Ch.4 | Ch.5 | Ch.6 | Deepest | Depth | RCI | Depth-T | RCI-T | RG | RG-T | |
|---|---|---|---|---|---|---|---|---|---|---|---|---|---|---|
| 0 | 40.1 | 31.8 | 35.2 | 44.9 | 44.6 | 31.6 | 44.9 | 0 | 0 | 13.2 | 15 | 0 | 4 | |
| 1 | 39.5 | 31.1 | 34.6 | 44.3 | 43.9 | 30.3 | 44.3 | 4.2 | 32 | 13.6 | 15 | 13 | 4 | |
| 2 | 39.8 | 31 | 36 | 44 | 44.4 | 29.7 | 44.4 | 4.9 | 30 | 14.05 | 15 | 11 | 4 | |
| 3 | 38.7 | 31.8 | 33.7 | 44.3 | 43.9 | 31.2 | 44.3 | 4.5 | 31 | 12.8 | 15 | 12 | 4 | |
| 4 | 38.1 | 31.4 | 33.7 | 44.2 | 43.2 | 30.5 | 44.2 | 5.5 | 28 | 13.25 | 15 | 10 | 4 | |
| 5 | 38.9 | 31.2 | 34.5 | 44.8 | 44.6 | 30.3 | 44.8 | 6.7 | 25 | 14.05 | 15 | 8 | 4 | |
| 6 | 39.2 | 30.6 | 35 | 44.9 | 44.8 | 31.6 | 44.9 | 6 | 26 | 13.8 | 15 | 9 | 4 | |
| 7 | 38 | 32 | 33.4 | 44.2 | 44.3 | 31 | 44.3 | 5.1 | 29 | 12.8 | 15 | 11 | 4 | |
| 8 | 37.9 | 30.7 | 35 | 44.8 | 44.3 | 32.3 | 44.8 | 6.8 | 24 | 13.3 | 15 | 8 | 4 | |
| 9 | 36.2 | 31.4 | 33.3 | 44.9 | 44.5 | 30.6 | 44.9 | 7 | 24 | 13.9 | 15 | 8 | 4 | |
| 10 | 37.6 | 31.6 | 34.5 | 44.9 | 44.8 | 31.5 | 44.9 | 8.7 | 21 | 13.35 | 15 | 6 | 4 | |
| 11 | 37.1 | 32.7 | 34.9 | 45.1 | 45 | 31.2 | 45.1 | 7.5 | 23 | 13.15 | 15 | 7 | 4 | |
| 12 | 34.8 | 32.4 | 36.3 | 45 | 44.3 | 30.9 | 45 | 7.9 | 22 | 13.35 | 15 | 7 | 4 | |
| 13 | 35.4 | 32.6 | 36.8 | 45.1 | 44.7 | 31.3 | 45.1 | 10.3 | 19 | 13.15 | 15 | 5 | 4 | |
| 14 | 34.7 | 33 | 37 | 44.8 | 45.1 | 29.5 | 45.1 | 9.7 | 20 | 13.85 | 15 | 5 | 4 | |
| 103 | 40.5 | 32.4 | 35.7 | 44.3 | 44.2 | 31.2 | 44.3 | 1.9 | 52 | 12.5 | 16 | 30 | 4 | |
| 104 | 41 | 32.3 | 37.6 | 44.3 | 44.6 | 32.2 | 44.6 | 4.1 | 33 | 12.35 | 16 | 13 | 4 | |
| 105 | 41 | 21.5 | 25.5 | 30.6 | 28 | 14.2 | 30.6 | 0.1 | 463 | 12.75 | 15 | 572 | 4 | |

END X-Coordinate = 3363730.41881878 END Y-Coordinate = 5035805.53756172
Distance Traveled = 97.5114442417472
Program Calculated Time: 24s
End Time: 9: 43: 34
Delay: 200
Calibration: Ch2 + 11.818
Ch3 + 13.037
Ch4 + 14.648
Ch5 + 16.517
Ch6 + 18.41

*Fig. 12*

SYSTEM AND METHOD FOR SOIL STRENGTH MEASUREMENT

TECHNICAL FIELD

The present invention relates to measurement systems and methods, and more particularly, some embodiments relate to soil density, soil shear resistance or soil penetration resistance measurement.

DESCRIPTION OF THE RELATED ART

Soil strength is a measure of the capacity of soil to resist deformation and can be discussed in terms of the amount of energy required to break apart aggregates or move implements through the soil or a measure of the amount of weight a given area will satisfactorily support. Field determination of soil strength is a common geotechnical procedure that is routinely carried out for a variety of different purposes. For example, soil strength determinations are useful to determine the loading characteristics of the soil for evaluating sites for construction of buildings and roads, design footings, airfields and the like; evaluation of terrain trafficability for passing personal, commercial and military vehicles; and estimation of impact induced into terrain by passing vehicles. Soil strength tests are well established and described in multiple standards such as ASTM D1194 (Load plates), D1586 (SPT), D3441 (CPT), D4429 (Bearing Ratio in place) and ASAE S313.2 (Soil cone penetrometer).

One method of determining the bearing capacity of soil is the cone penetrometer test, which using a conical shaped tool to measures the penetration resistance of the soil. The cone penetrometer test is conducted with a conical-tipped penetrometer, which is pushed into the ground at a constant rate. During this process, forces on the cone are measured. The measured forces can provide information such as, for example, stratification, soil type, soil density and so on. The essence of the cone penetrometer technique is a measurement of soil resistance to penetration of a load of particular weight and shape at different depths.

Standard military practice for field measurement of soil strength is based on the use of a manually operated cone penetrometer and the similar Airfield penetrometer (AP). Cone penetrometer measurements typically characterize soil penetration resistance in what are referred to as cone index values. Field data can be acquired with a hand-held cone penetrometer, and even in the best of circumstances, cone penetrometer data are subjective and inaccurate. Cone penetrometer testing is often augmented with time consuming soil sampling and remolding of the sample to obtain a rating cone index (RCI), which is the product of multiplying the cone index by the remolding index (See, Field Manual 5-430-00-1, 1994). Cone penetrometer is a manually operated device requiring a trained operator, and prevents total automation of trafficability evaluation. To obtain reliable results all these procedures include extensive laboratory tests of soil properties.

All methods listed above provide measurement of soil strength only in discreet points, require extensive manual operations and are not well suited to automation. The civilian and military geotechnical and soil engineering communities alike would benefit from a more automated and continuous method for measurement soil strength in the field to comply with state-of-the-art terrain analysis based on Geographic Information Systems (GIS), trafficability and mobility models.

One technique for continuous measurement of soil mechanical impedance uses a device known as a coulter penetrometer and provides data represented by a Coulter Index, which is correlated with Cone index (See, *Development of and Electro-Mechanical System to Identify & Map Adverse Soil Compaction Using GIS&GPS*; S. K. Pilta, L. G. Wells; ASABE Presentation, Paper #061056, 2006). The Coulter Penetrometer is an electro-mechanical penetrometer that can be added to a vehicle such as, for example, a tractor, to continuously measure soil resistance using strain gauges.

Also it is well established that wheel sinkage or track depth normalized by vehicle and wheel parameters can be correlated with the rated cone index for cohesive, clayey soil and with the cone index for loose, sandy soil. These correlations are represented in the WES numerics. Therefore, continuous measurement of track depth while a vehicle is traveling across a given terrain can be a remote estimate of soil penetration resistance.

Ground surface profilometry is a technique that can be used to measure road surface roughness using laser-ranging technology. Profilometers such as the Dynatest Road Surface Profilometer® are used to provide an automated pavement roughness measurement. Such devices are capable of real time continuous highway-speed measurements of longitudinal profile (International Roughness Index (MRI) and Ride Number (RN)), transverse profile, rut depth, macro texture and geometrics (crossfall, curvature and gradient). Measurements can be referenced to linear chainage or Differential Geographical Positioning System (DGPS), allowing easy integration to Geographic Information Systems (GIS).

FIG. 1 is a diagram illustrating example conventional measurement techniques for terrain factors measurement. As illustrated, geographic information systems 24 are used to perform topography mapping 12 and soil type determinations 13. Satellite aerial imaging 25 is used for a variety of things including soil type determinations 13, vegetation analysis 15 including type and density determination, and hydrology 16. Surface roughness 18 and wetness/slipperiness 21 can be determined through ground penetrating radar 28, and slipperiness 21 can also be determined using neutron probe techniques 29. Currently, soil strength 17 is measured using the cone penetration techniques 27 as described above. Accordingly, soil strength measurement, is the only measurement/determination of the group that is performed manually.

BRIEF SUMMARY OF EMBODIMENTS OF THE INVENTION

According to various embodiments of the invention optical, ultra-wideband or other distance measuring devices can be mounted to a vehicle and used to determine the distance between the sensors and the soil surface being measured. Preferably, multiple sensors can be used to measure distances from the sensors to the ground in areas where a wheel of the vehicle has traveled as well as areas where the wheel has not traveled. The measurements can be compared to determine the depth of a track made by the tire or wheel of a vehicle as the vehicle traveled along on the soil. The track depth can be used to determine parameters such as, for example, a cone index or a rating cone index.

Various sensor configurations can be utilized to measure and determined track depth, which is used to calculate soil strength. For example, sensors can be located in front of and behind a given wheel of the vehicle to measure the distance from the sensor to the surface of the ground both in front of and behind the wheel. The difference between these two measurements can be used to determine the depth of the track made by the wheel traversing that section of the soil. Likewise, an array of a plurality of sensors normal direction of travel (or otherwise not along the direction of travel) can be used to measure the distance from the sensor to the surface both behind the wheel and at one or more areas where the wheel has not traveled. Likewise, these multiple measurements can be used to calculate the depth of the track made in the soil by the wheel.

Commercially available sensors can be used to measure the distance from the sensors (preferably mounted to a fixed mounting point on the vehicle) to the surface of the ground. For example, optical measurement of distances using laser triangulation devices provides suitable results to an accuracy acceptable for soil strength calculations. The system can be configured such that data can be read from multiple sensors and further configured to allow differential measurement from a moving platform. In one embodiment, this can be used to avoid processing otherwise required to accommodate platform bouncing.

The use of optical, ultra wideband, or other like measurement technologies can be used to provide a non-invasive, automatic method to measure the deformation of the upper soil layer in reaction to the load provided by a wheel of a moving vehicle. As noted, in one embodiment, a front wheel of the vehicle is used as that object can be measured as compared to soil that has been untouched by the vehicle. In one embodiment, the sensors can be configured to take measurements from a regular wheel of a vehicle such that no additional wheels are required to perform the measurements.

Accordingly, deformation of the upper soil layer by the wheel of a moving vehicle can be correlated with the cone index characterizing soil shear strength or other soil properties. In one embodiment, the device can also perform spectroscopic measurement of soil moisture content, as well as the presence and state of soil vegetation coverage. This information might be used, for example, to determine the validity of the soil measurement data received. For example, where vegetation exists, it may be difficult to obtain accurate distance measurements to the soil surface or the bottom of a track due to factors such as, for example, density of vegetation, vegetation height and so on. As another example, the tendency for vegetation to 'lie down' behind the wheel may potentially result in what appears to be a deeper track depth due to the presence of vegetation flattened by the wheel.

The deformation of upper soil layer is in reaction to the load provided by a regular front wheel of moving vehicle. In one embodiment, the measurement process correlates the measured values of deformation with the cone index to arrive at soil shear strength. The system can also be configured to perform spectroscopic measurement of soil moisture content, presence and state of soil vegetation coverage and other characteristics. In one embodiment, the system performs differential measurement of the vehicle's wheel sinkage (track depth) using two arrays of laser triangulation sensors installed in front and behind the forward wheel of the vehicle. This architecture allows for synchronous measurement of distance from the sensors to the surface of intact soil (front array or outside sensors of rear array) and to the surface of the soil deformed by the wheel's load (rear array or central sensor of rear array). The difference between measurements of distances from sensor to intact and deformed soil gives the value of track depth, which correlates with the cone index value. The system can be implemented in one embodiment on any off-road vehicle and can be assembled with a GPS receiver and computer providing automatic real-time mapping of soil penetration resistance.

A system and method for characterizing soil shear strength from a vehicle, comprises a plurality of sensors mounted on a vehicle and configured to measure a distances from the sensors to the soil surface. The sensors comprise a first sensor disposed on the vehicle and configured to measure a first distance between the first sensor and the soil and a second sensor disposed on the vehicle and configure to measure a second distance between the sensor and a track made in the soil by the vehicle, wherein the first sensor measures the distance at a location before the vehicle wheel travels over that location and the second sensor measures the distance to the bottom of the track made by the wheel. A processing module is communicatively coupled to the sensors and is configured to calculate track depth as a function of the first and second distance measurements; and to derive soil shear strength as a function of the calculated track depth. In one embodiment, the track depth is calculated as a difference between the first and second distances.

In accordance with one embodiment of the invention, the first sensor is mounted to the vehicle in a position in front of a vehicle wheel to thereby measure the distance to a location on the ground before that location is traveled on by the wheel when the vehicle is moving, and the second sensor is mounted to the vehicle in a position behind the vehicle wheel to thereby measure the distance to a point in a track made by the wheel after it has traveled over that point on the ground. In one embodiment, the first and second sensors comprise a plurality of sensors arranged in an array behind the wheel, and the array can be arranged normal to or approximately normal to the direction of travel of the vehicle.

Where a plurality of sensors are used to measure distance to either untouched soil or to the track, the invention can be configured in one embodiment to determine which sensors of a plurality of sensors are used to measure the respective distances. For example, determining which of a plurality of sensors to use comprises selecting from the plurality of sensors the sensor that indicates the greatest distance measurement. As another example, determining which of a plurality of sensors to use can be performed by selecting a sensor based on wheel angle or evaluating measurements from a plurality of sensors and selecting the sensor showing the greatest measured distance. In addition, the distances from a plurality of sensors can be measured and the first distance determined as a function of the plurality of distance measurements. Determining the first distance can be calculated, for example, by averaging the plurality of distance measurements or comparing the distance measurements and discarding an outlier data point.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

FIG. 12 shows an example of a fragment of data file in accordance with one embodiment of the invention.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

The present invention is directed toward a system and method for soil measurement and analysis. In one embodiment, one or more sensors or sensor arrays are used to measure the deformation of a surface layer of the soil in reaction to a load placed on the soil. Preferably, in one embodiment, the measurements are made with respect to a moving load traveling along the surface of the soil, and the measurements capture the pre and post-deformation state of the soil. Although any of a number of mechanisms might be used to provide a load moving across the surface of the soil to provide measurable deformation, in one embodiment, one or more wheels of a vehicle moving across the soil are used to provide the load. Various sensor devices and configurations can be utilized perform the measurement function and determine the amount of deformation caused by the load.

Before describing the invention in detail, it is useful to describe an example environment with which the invention can be implemented. One such example is that of a vehicle traveling along an area in which soil measurements are desired. An example of such a vehicle might be a Humvee®, Jeep®, tank, truck, automobile, or other vehicle as appropriate in a given application, location or environment. The vehicle may ride on wheels and tires, tracks, or other conveyance mechanisms. The aforementioned sensors might be mounted directly to the vehicle itself or its frame, or an appropriate bracket or brackets or other mounting mechanism might be attached to the vehicle on which the sensors can be affixed. From time-to-time, the present invention is described herein in terms of this example environment of a vehicle with sensors mounted thereon and traveling across an area to be measured. Description in terms of this environment is provided to allow the various features and embodiments of the invention to be portrayed in the context of an exemplary application. After reading this description, it will become apparent to one of ordinary skill in the art how the invention can be implemented in different and alternative environments.

Figure 2A:
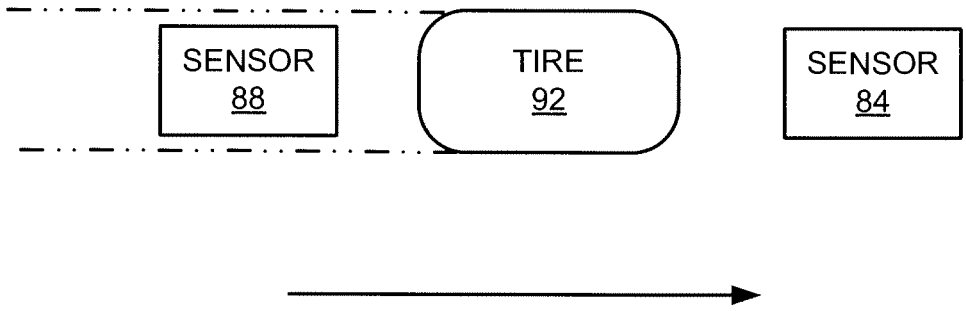
FIGS. 2A and 2B are diagrams illustrating two possible examples of sensor layout configurations in accordance with embodiments of the invention.
Figure 2B:
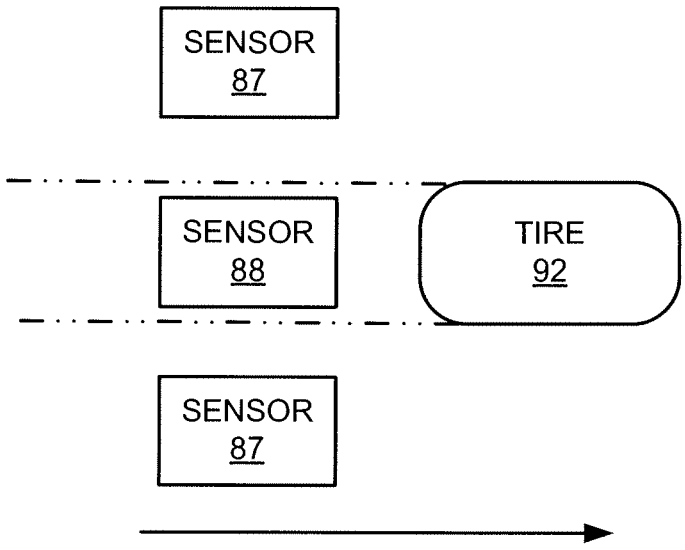

In one embodiment, the invention can be configured to perform a differential measurement of the vehicle's wheel sinkage or track depth using arrays of sensors installed in front of and behind the front wheel of a vehicle or installed to measure deformed and non-deformed soil. FIGS. 2A and 2B are diagrams illustrating two possible examples of sensor layout configurations in accordance with embodiments of the invention. Referring now to FIG. 2A, two sensors or sensor arrays are provided. In this example, a first sensor 84 is provided in front of a wheel 92 and a second sensor 88 is provided to the rear of wheel 92. The arrow indicates the forward direction of travel. Accordingly, given a forward direction of travel for the vehicle, and assuming the vehicle is traveling in untraveled territory, sensor 84 measures the distance from the sensor to the untouched soil. In this scenario, sensor 88 measures the distance to the bottom (at least approximately) of the track created by wheel 92 rolling across the soil.

Referring now to FIG. 2B, an example configuration is illustrated wherein sensors are provided to measure the distance from the sensors to the track as well as the distance from the sensors to one or more points adjacent the track. Particularly, as was the case illustrated in FIG. 2A, a sensor 88 is provided to measure the distance from the sensor to the surface of the track. One or more sensors 87 are provided adjacent to the track to measure distances to the untouched soil. In yet another embodiment, additional sensors can be provided to make multiple measurements of a plurality of different areas of terrain. Additional sensor might be configured to allow the system to make multiple measurements at multiple locations. Such measurements might be useful to allow additional processing to refine the measurement process. For example, such measurements might be used to allow the system to determine whether the track is actually being made in untouched soil, whether the soil has been previously deformed and so on. As these simple examples serve to illustrate, a variety of different sensor configurations can be provided to perform a differential measurement of track depth resulting from a traveling vehicle.

A wheel, tread, ski, track or other like structure (generally referred to as a "wheel") of any moving vehicle can be considered as a load penetrating into the soil under the pressure of vehicle weight. The depth of the track left by a wheel in the soil depends on the soil bearing capacity for the given shape and contact patch of the wheel, load on the wheel, and tire pressure. From this point of view, a wheel inducing deformation of soil can be compared with the special geotechnical tools previously used for measuring soil shear resistance. The track depth can be measured remotely from the moving vehicle using measurement devices. In one embodiment, remote or contactless sensors such as, for example, optical or other sensors such as those described above can be used. A processing or other computing module can be provided to establish a correlation between cone index and the track depth (sinkage) for a particular vehicle, thereby allowing for measuring RCI automatically without involving special soil deforming equipment. Where the system is preprogrammed to make such determinations and calculations, data can be output or displayed and measurements determined without the need for a trained operator. Accordingly, in one embodiment the system provides an automatically functioning fast quantitative system for estimating soil bearing capacity and soil trafficability of the site.

The rolling resistance of a wheel is a function of the strength/deformation properties of the surface and the size and deformation characteristics of the wheel. For wheels with tires, secondary factors considered in the determination include the air pressure in the tire, the structure of the tire carcass (for example, radial or bias ply), the tire aspect ratio, and the tread pattern. When low speed vehicles move across off-road terrain, rolling resistance is relatively independent of the speed of deformation of the soil and the tire, and hence of the travel speed. Two models of the wheel-surface interaction are relevant to this case. These are a hard wheel on soft surface and soft wheels on a soft surface. In the case of a hard wheel on a soft surface, most of the deformation and energy loss occurs in the surface, which yields plastically but does not recover. In the case of a soft wheel on soft surface, both the wheel and the surface deform significantly. Typically, though, energy loss occurs mainly in deforming the soil. One theoretical approach to the interaction between a driving wheel and the soil assumes that the wheel is equivalent to a plate continuously being pressed into the soil to a depth equal to the depth of the track produced by the wheel.

Figure 3:
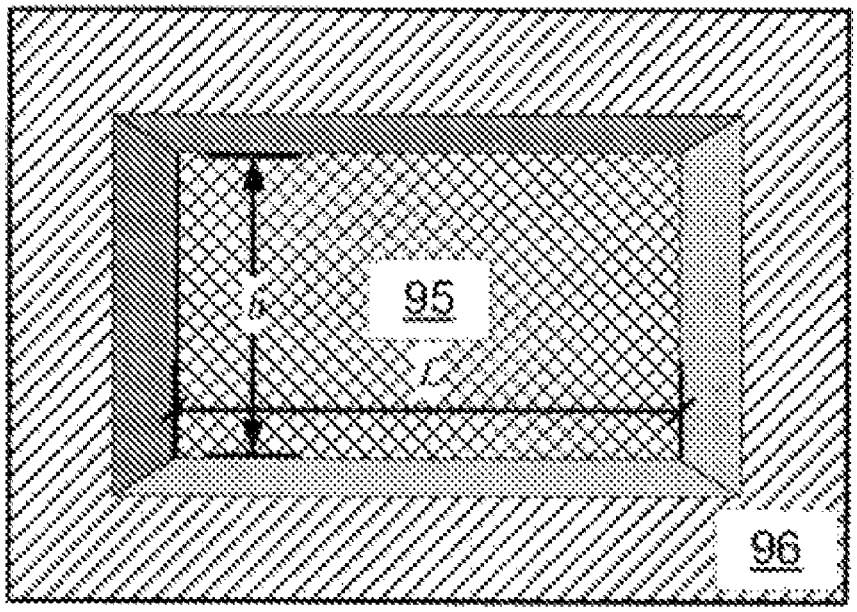
FIG. 3 is a diagram illustrating an exemplary model for determining pressure of a plate being pushed into soil.

FIG. 3 is a diagram illustrating a model for determining pressure of a plate being pushed into soil, wherein a plate 95 of length l and width b is being pressed into the soil 96. In this case, the pressure p under such a plate can be expressed as:

$$p = \left(\frac{k_c}{b} + k_\phi\right) z^n$$

where z is the vertical soil deformation (sinkage), kc and kϕ are soil sinkage moduli, and n is the soil sinkage exponent.

The shear stress/deformation relationship for soils can take different forms depending on the normal and shear stresses under which they were compacted and their degree of cementation (bonding together of the soil particles). The simple analysis is applicable to loose and/or uncemented soil with slowly rising shear stress/deformation characteristics. The soil shear stress (S)/deformation characteristic for such a soil is assumed to have the following form:

$$S=(c+\sigma \tan \phi)(1-e^{-j/k})$$

where c=soil cohesion, ϕ=angle of internal friction, σ=normal stress, j=shear deformation, and k=shear deformation modulus.

Figure 4:
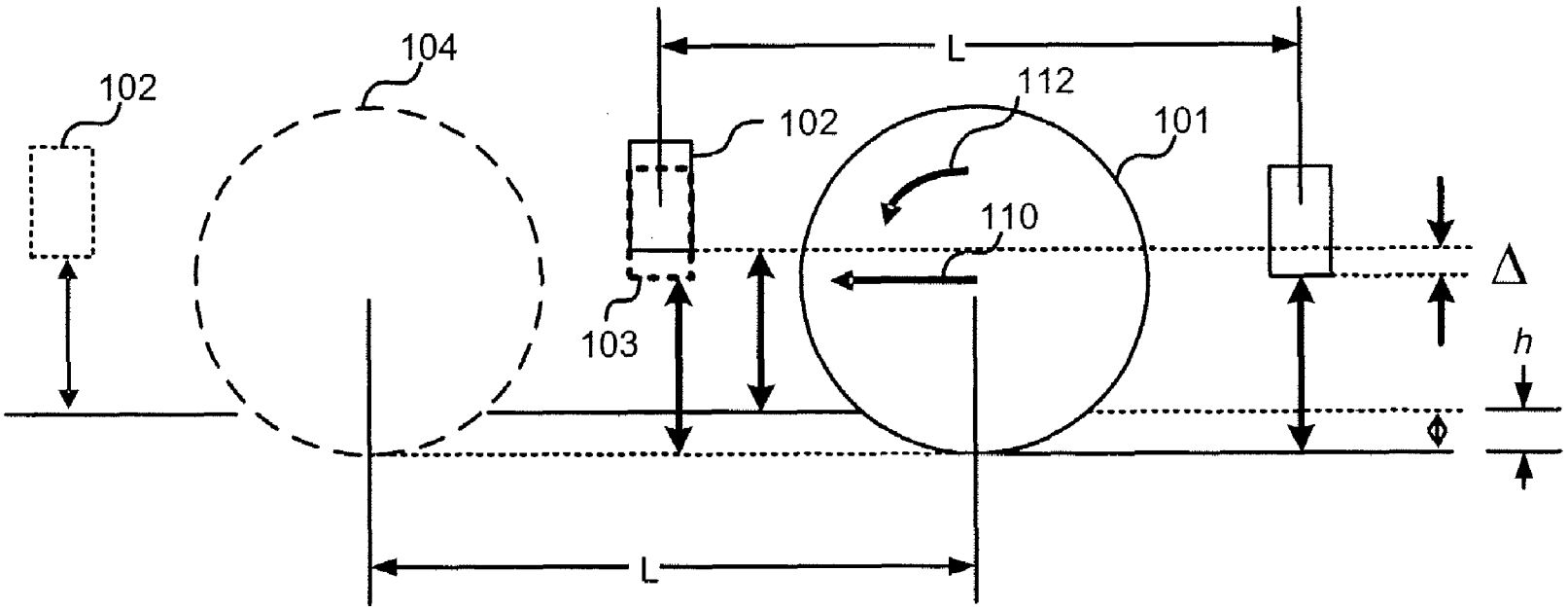
FIG. 4 is a diagram illustrating an example system for soil strength measurement in accordance with one embodiment of the invention.

FIG. 4 is a diagram illustrating an example system for soil strength measurement in accordance with one embodiment of the invention. Referring now to FIG. 4, Illustrated is a vehicle wheel 101 moving in a direction indicated by arrow 110 with a direction of rotation indicated by arrow 112. Referring now to FIG. 4, the example system includes two sensors 102, 103 positioned to measure the distance from the sensors to the ground, where sensor 102 is mounted in front of wheel 101 and Sensor 103 is mounted behind the wheel 101. Dashed lines indicate the position of the wheel 104 and sensors 105, 109 after traveling a distance L from a time t1 to a time t2. Track depth h can be measured instantaneously as a comparison of the difference between the distances measured by sensor 102 in front of wheel 101 and sensor 103 behind wheel 101 at any given time.

However, to compare the before and after measurements from the sensors at the same point in the soil, the vehicle speed is determined and used to calculate the time that it takes for the vehicle to travel the distance L between the sensors. The measurements from sensors 102, 103 for comparison can then be chosen to correspond to the same point on the ground for difference measurements. In such an embodiment, the difference, or track depth h, can be determined at the time moment t2 as a difference between the distances from the front sensor 102 to the surface of intact soil at the time moment t1 and from the rear sensor 103 to the surface of deformed soil at the time moment t2, where the time elapsed from t1 to t2 is the time it takes for the vehicle to travel a distance L. Accordingly, at this moment t2, the rear sensor 103 is located to measure the same position on the soil that was measured by the front sensor 102 at time t1. In this embodiment, the track depth at a time t2, ht2, is given by $$h_{t2}=D_{S2t2}-D_{S1t1}\pm\Delta$$

where, $D_{S2t2}$ is the distance measured by sensor rear sensor 103 at a time t2, and $D_{S2t1}$ is the distance measured by front sensor 102 at a time t1. The correction factor, Δ, can be included to account for any difference in mounting height of sensors 102, 103 from the ground. In one embodiment, the system can be calibrated by measuring $D_{S2t2}$ and $D_{S2t1}$ on a known surface, such as a hard surface, to determine the offset Δ, if any, between the mounting heights of the two sensors. If vehicle loading changes, this could change the ride angle of the vehicle, thereby changing the offset of the sensors relative to one another. Accordingly, the system can be recalibrated as needed.

It should be noted that the terms "front" and "rear" are used to describe locations of sensors with respect to the wheel and such designation can be made independently of the actual front or rear of the vehicle. For example, in one embodiment, the terms "front" and "rear" are used with reference to the direction of travel of the wheel or vehicle.

Figure 5:
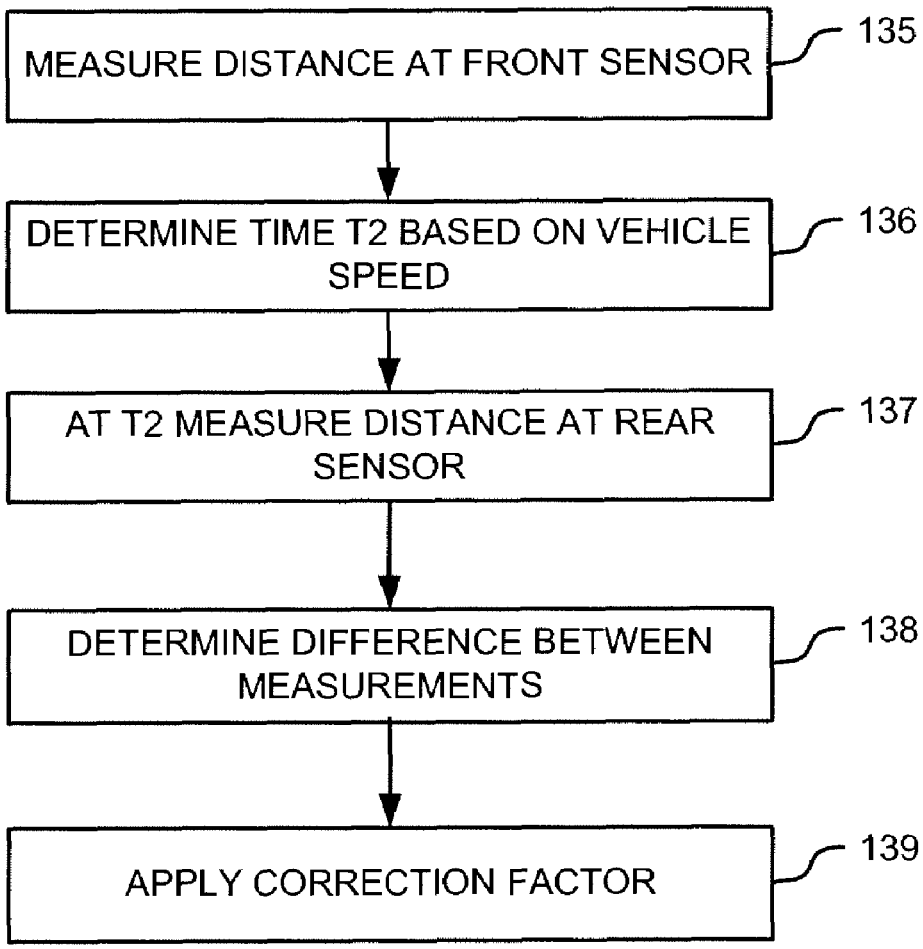
FIG. 5 is a diagram illustrating an example process for track depth measurement in accordance with one embodiment of the invention.

FIG. 5 is a diagram illustrating an example process for track depth measurement in accordance with one embodiment of the invention. Referring now to FIG. 5, in a step 135 the distance is measured by the front sensor 102 at a time t1 in front of the wheel. In a step 136, the amount of time it will take rear sensor 103 to reach the same location as sensor 102 was at the time of the first measurement, is determined. In one embodiment, this determination can be a simple calculation of the amount of time to take for the people to travel a distance L given current vehicle speed. The time at which censor 103 reaches the position of sensor 102 is referred to as time t2.

In a step 137, and time t2, sensor 103 measures the distance to the bottom of the track or wheel rut. In a step 138, the difference between the two measurements can be determined to determine the track depth. In most cases, this can be accomplished with a simple subtraction of the two distances measured wherein the difference yields the track depth. In situations where sensors 102, 103 might not be mounted at the same distance from the ground, a correction factor can be applied to account for a different mounting height. Accordingly, in step 139 the correction factor is applied and the track depth determined.

Depending on sensor and vehicle configuration, situations might arise wherein sensors are not optimally positioned to measure track depth. One such example scenario is a case where a vehicle is making a turn and, as a result, the rear sensors are no longer positioned over the current location of the track. In one embodiment, the rear sensors are positioned as close to the wheel as practical to minimize the occurrence of this event. However, in situations where the wheels are turned at a sharp angle, the rear sensors might still measure outside the track.

Accordingly, in one embodiment, a broader area can be measured to help ensure coverage of the actual track location and processing techniques can be used to determine the appropriate point or points from which to make measurements. For example, data from a plurality of measurement points can be obtained and digital signal processing or other techniques used to determine the appropriate measurement point or points to calculate track depth. In an alternative embodiment, an array of sensors used to measure multiple points across the anticipated track location can be used and the information from the sensors evaluated to determine which measurements can be used to yield a depth measurement.

Figure 6:
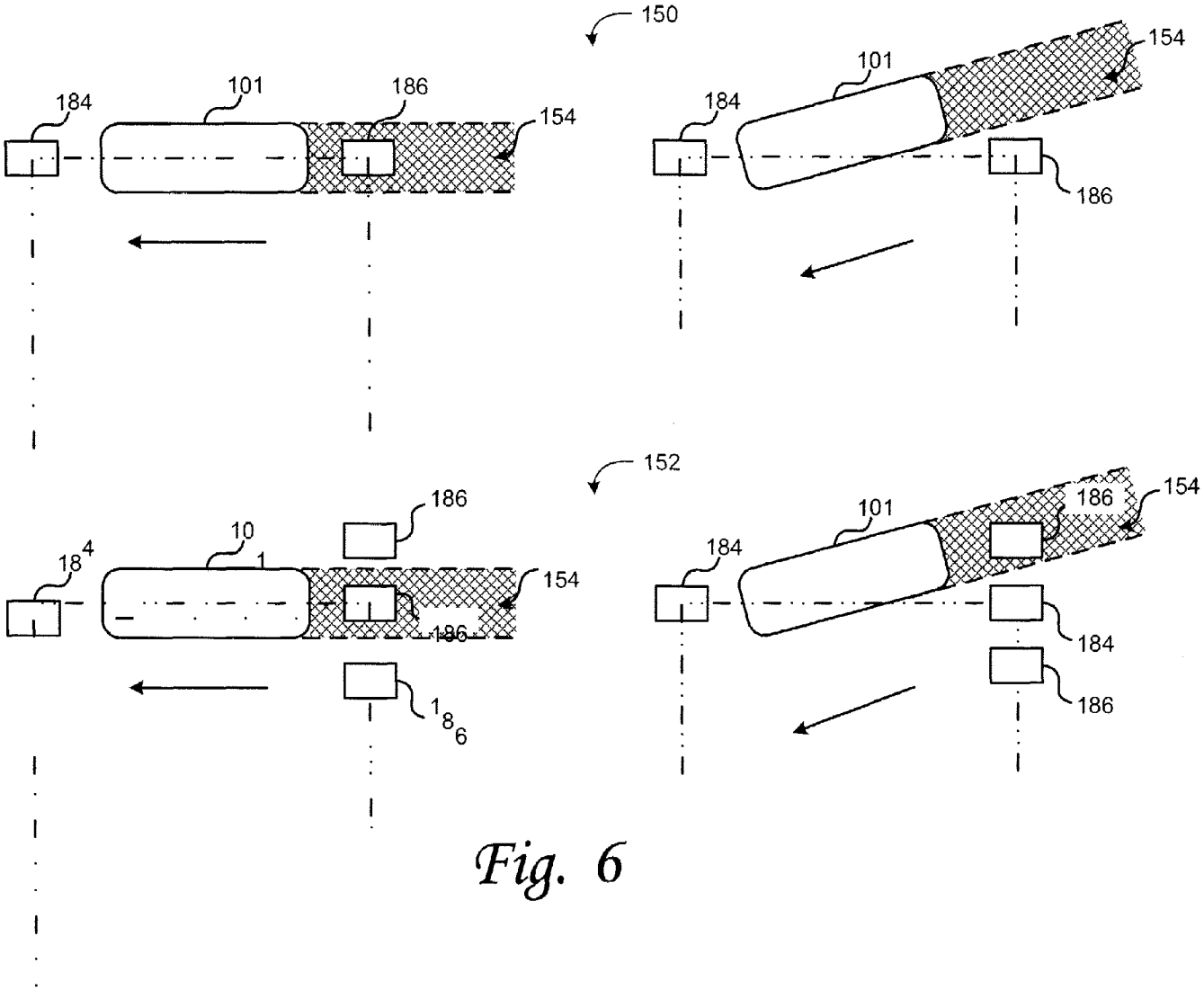
FIG. 6 is a diagram illustrating an example scenario wherein a plurality of sensors are mounted in the rear position in accordance with one embodiment of the invention.

Accordingly, for example, an array of a plurality of sensors can be used to take into account the case when the vehicle moves along a curved path. FIG. 6 is a diagram illustrating an example scenario wherein a plurality of sensors are mounted in the rear position to improve the probability that at least one rear sensor will be in an appropriate position to measure the depth of the track created by the tire. Referring now to FIG. 6, two scenarios are illustrated. In scenario 150, there is only one rear sensor 186, while in scenario 151, there is an array of three rear sensors 186. While three rear sensors 186 are shown, one of ordinary skill in the art will understand after reading this that other quantities of sensors 186 can be utilized. Additionally, increasing the number of sensors 186 and decreasing the spacing between them will, in most cases, improve the probability that at least one of the sensors 186 will be able to measure the distance to the center of the track 154 created by the tire 101. Center measurements are typically preferred, as measurements near the edges of the track 154 may not accurately reflect the actual track depth. This is especially true with tires and even more so with radial tires, which tend to have a rounded transition from the contact patch to the sidewall.

As FIG. 6 illustrates, in the single-sensor scenario 150, as long as the vehicle is moving in a somewhat straight line, and the wheel angle with respect to the frame is within a certain range, a single sensor 186 can be relied upon to obtain measurements of the track 154 at or near its center. However, as the wheel angle increases such as, for example, during sharper turns, in this scenario the sensor may miss measuring the track depth. As illustrated in scenario 150, with the wheel turned greater than a given angle, sensor 186 is measuring the distance to ground untouched by the wheel 101. However, in the multi-sensor scenario 152, the plurality of sensors 186 are arranged in an array so as to capture measurements that include a measurement to the tire track 154 even when wheel 101 is turned.

A variety of techniques can be used to determine which sensor 186 is obtaining valid data to the bottom of the track. For example, comparative analysis can be made between the data obtained from all sensors 186, and the sensor measuring the greatest distance or the deepest point in the track profile is used for the distance measurement. As another example, wheel or steering angle sensors can be used to determine wheel angle and turning direction during turns, and this information used to select a subset of one or more of the plurality of sensors from which to use the measurement data. A combination of these techniques can be used to improve the probability of correctly determining the sensor from which to obtain the data.

Figure 7:
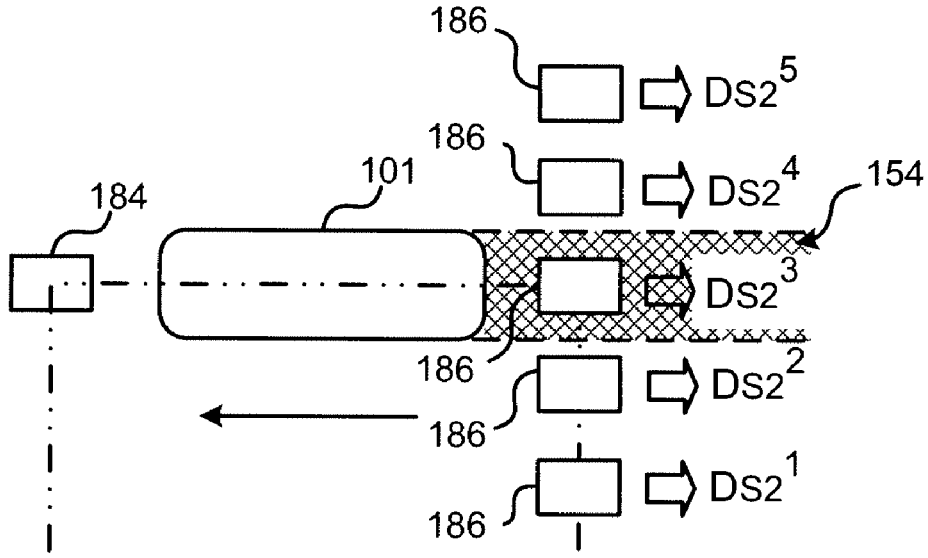
FIG. 7 is a diagram illustrating another example configuration wherein a plurality of rear sensors are mounted in the rear position in accordance with one embodiment of the invention.
Figure 7:
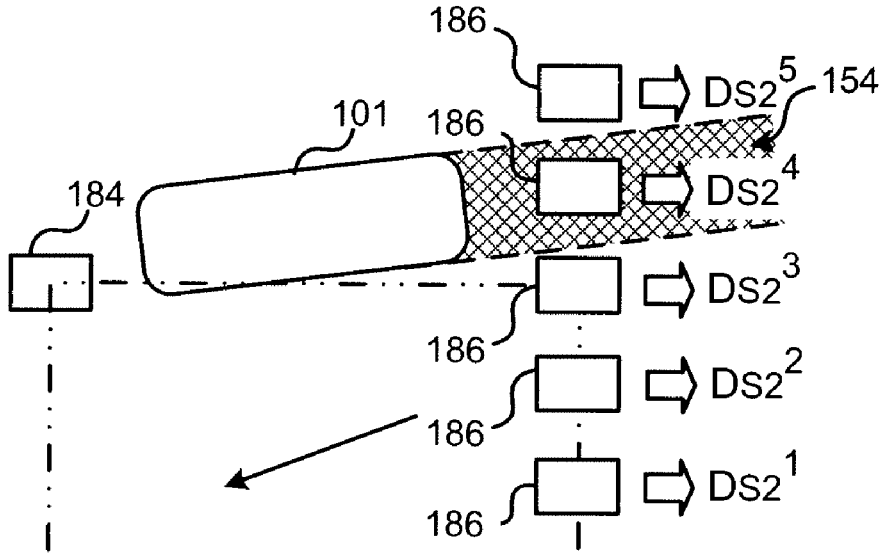

FIG. 7 is a diagram illustrating another example configuration wherein a plurality of rear sensors 186 are used. In this example, five rear sensors 186 are used to measure distances. Where there are sufficient sensors to measure the distance to the tire tracks as well as to untouched soil, measurements from the rear sensors 186 alone are sufficient to determine track depth. For example, consider the scenario illustrated in FIG. 7 where there are five sensors 186 outputting measurement data D. Where the vehicle is moving in a relatively straight line, the middle sensor (outputting data $D_{S2}^{3}$) is measuring the distance to the bottom approximate center of the track. In this situation, the outermost sensors 186 are most likely measuring soil not touched by the vehicle, even at minimal steering angles. Accordingly, in one embodiment, the data from the outermost sensors (depicted as outputting data $D_{S2}^{1}$ and $D_{S2}^{5}$) can be averaged and used to compare with the measurement of the middle sensor to determine track depth. This is shown as follows:

$$h_{t1}=D_{S2}^{3}{}_{t1}-\tfrac{1}{2}(D_{S2}^{1}{}_{t1}+D_{S2}^{5}{}_{t1})\pm\Delta$$

Figure 8:
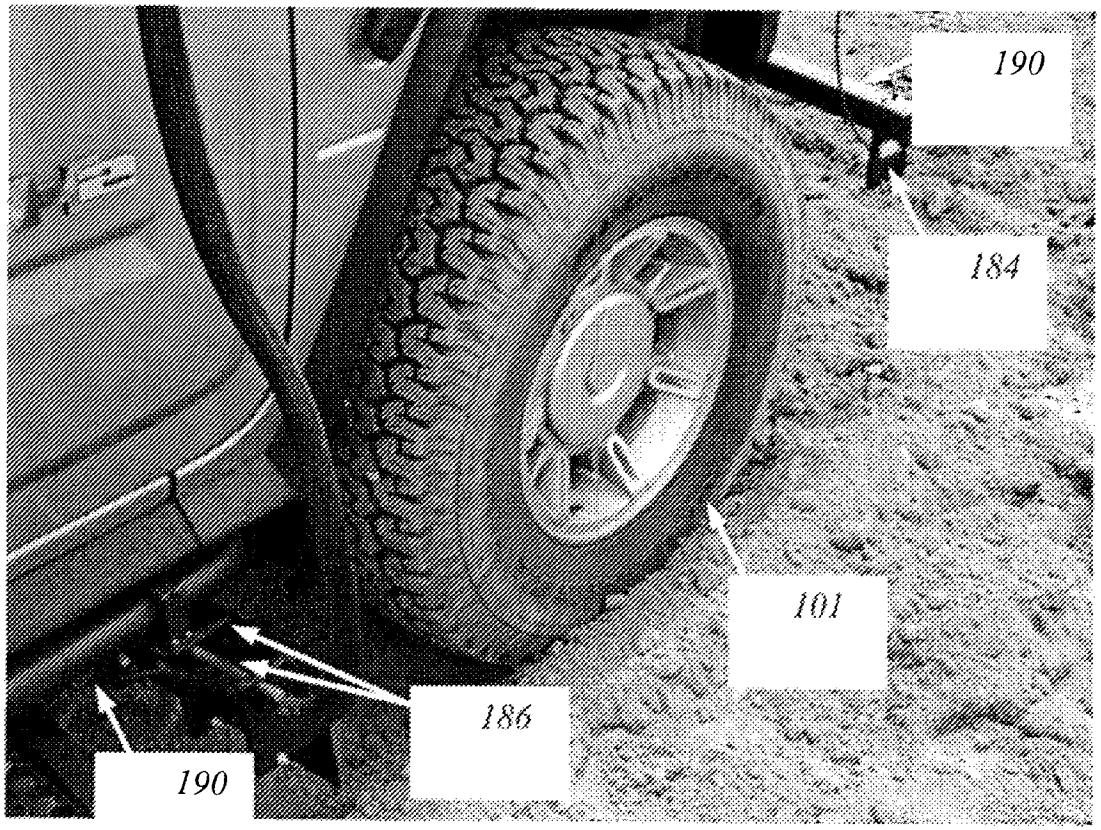
FIG. 8 is a photograph illustrating an example configuration of sensors mounted on a mounting frame attached to a test vehicle in accordance with one embodiment of the invention.

In this example, all measurements are taken at the same time (t1 in this example). FIG. 8 is a photograph illustrating an example configuration of sensor 184, 186 mounted on a mounting frame attached to a test vehicle.

Averaging two or more sensors can be useful to account for normal perturbations in the soil. In addition to simple averaging, measurements from a plurality of non-track-measuring sensors can be evaluated to perform calculations such as weighted averaging or to throw out outlying data points and the like. For example, consider a scenario where there is a rock in the vicinity of the path of the vehicle. If the measurement from the sensor to the rock is used to compare to the track sensor, the data will be skewed. Therefore, information from the group of current non-track-measuring sensors 186 can be compared and data from a sensor that is outside the range of the other sensors by a predetermined amount can be discarded. Also, sensor 184 can be used for the before soil measurement, preferably with a compensation for the time of travel, and data from sensors 186 can be compared with data from sensor 184 to aid in determining a more accurate untouched soil measurement.

Additionally, measurement data can be compared in time with prior and subsequent measurements to determine whether any measurement data should be discarded as unreliable. Consider again the scenario where a rock is near the path of the vehicle and the resultant measurement is not the distance difference between the soil surface and the bottom of the track, but is instead the distance difference between the top of rock and the bottom of the track. The resultant depth measurement would appear out of line with other data points before and after that time. Accordingly, this depth measurement could be discarded. The window of time in which depth measurements can be compared with temporally surrounding measurements can be configured as a fixed length or it might vary depending on, for example, vehicle speed, terrain patterns, and so on.

A number of commercially available options for distance measurement can be used to implement the sensors, including optical, UWB and other measurement devices. In one embodiment, optical measurement of track depth is based on the principle of optical triangulation. A collimated laser beam is sent from the sensor toward the ground, reflected from the surface and is focused on a position-sensitive photo detector such as, for example, a detector array. The displacement Δx of the light spot on the active area of the detector will vary with the distance between the detector and the reflecting surface; the greater the distance, the larger the displacement. This distance L is computed according to a simple formula: L=d*f/Δx, where d is the distance between the light source and the detector and f is the focal length of the receiving lens. Displacement of the light spot along the active area of a position-sensitive detector (PSD) causes variation in the output current of the PSD, which can be measured and digitized to determine the distance. Although any of a number of PSDs could be used, one example of such sensors is model OADM 20I6480/S14F manufactured by Baumer Electric. It supports distance measurement range from 10 to 60 cm at high speed (0.9 ms response time). It uses a red laser with a beam spot diameter of 2 mm allowing precise measurement from a moving vehicle. At the speed of 20 km/hour each measurement can be taken every 5 mm.

Having described various example embodiments of determining track depth, determining soil strength is now described. The following empirical equation links a sinkage or a track depth to vehicle parameters and rated cone index (RCI) for cohesive clayey soils (Equation (1)) and loose sandy soil (Equation (2)).

$$RD = 5Dt \Big/ \left[ \frac{RCI}{\left[\frac{Mv/nW}{Dt \cdot Wt}\right]\left[1 - \left[\frac{Td}{Ts}\right]\right]^{3/2} \cdot 0.7247797} \right]^{5/3} \tag{3}$$

$$RD = 14Dt \Big/ \left[ \frac{RG \cdot (Wt \cdot Dt)^{3/2}}{(Mv/nW) \cdot (1 - Td/Ts)^3 \cdot (1 + Wt/Dt)} \right]^{5/3} \tag{4}$$

Here, RD is Wheel Sinkage or Track Depth (in.), RCI is Rating Cone Index of the soil (unitless), RG is a penetration resistance gradient (Cone Index/in), Dt is Tire Diameter (in.), Wt is Single Tire Width (in.), Mv is Total Vehicle Weight (lb), n W is Total Number of Wheels (unitless), Td is Tire Deflection (in.) and Ts is Tire Section Height (in.). These parameters can be understood with reference to FIG. 9, which illustrates an example of tire deflection as a result of loading for a tire 180 mounted on a wheel 177.

If the denominator $$\left(\left[\frac{Mv/nW}{Dt \cdot Wt}\right]\left[1 - \left[\frac{Td}{Ts}\right]\right]^{3/2} \cdot 0.7247797\right),$$

which contains parameters of a particular vehicle, wheel and tire configuration, we denote as X then the equation for wheel sinkage (track depth) can be rewritten in a simplified form:

$$RD = \frac{5Dt}{\left[\frac{RCI}{X}\right]^{5/3}}.$$

Now, the expression for RCI linking the track depth with the vehicle parameters can be derived from this simplified expression:

$$RCI = [X^{5/3} \cdot (5Dt/RD)]^{3/5}.$$

For estimation of RG, if Xs is given by:

$$X_s = \frac{(Wt \cdot Dt)^{3/2}}{(Mv/nW) \cdot (1 - Td/Ts)^3 \cdot (1 + Wt/Dt)},$$

then wheel sinkage (track depth) can be written as:

$$RD = \frac{14Dt}{X_s \cdot RG},$$

and solving this expression for RG yields:

$$RG = 14Dt/(RD \cdot X_S).$$

Where components or modules of the invention are implemented in whole or in part using software, firmware or other code elements (generally referred to as software), in one embodiment, these software elements can be implemented to operate with a computing or processing module capable of carrying out the functionality described with respect thereto.

Figure 9:
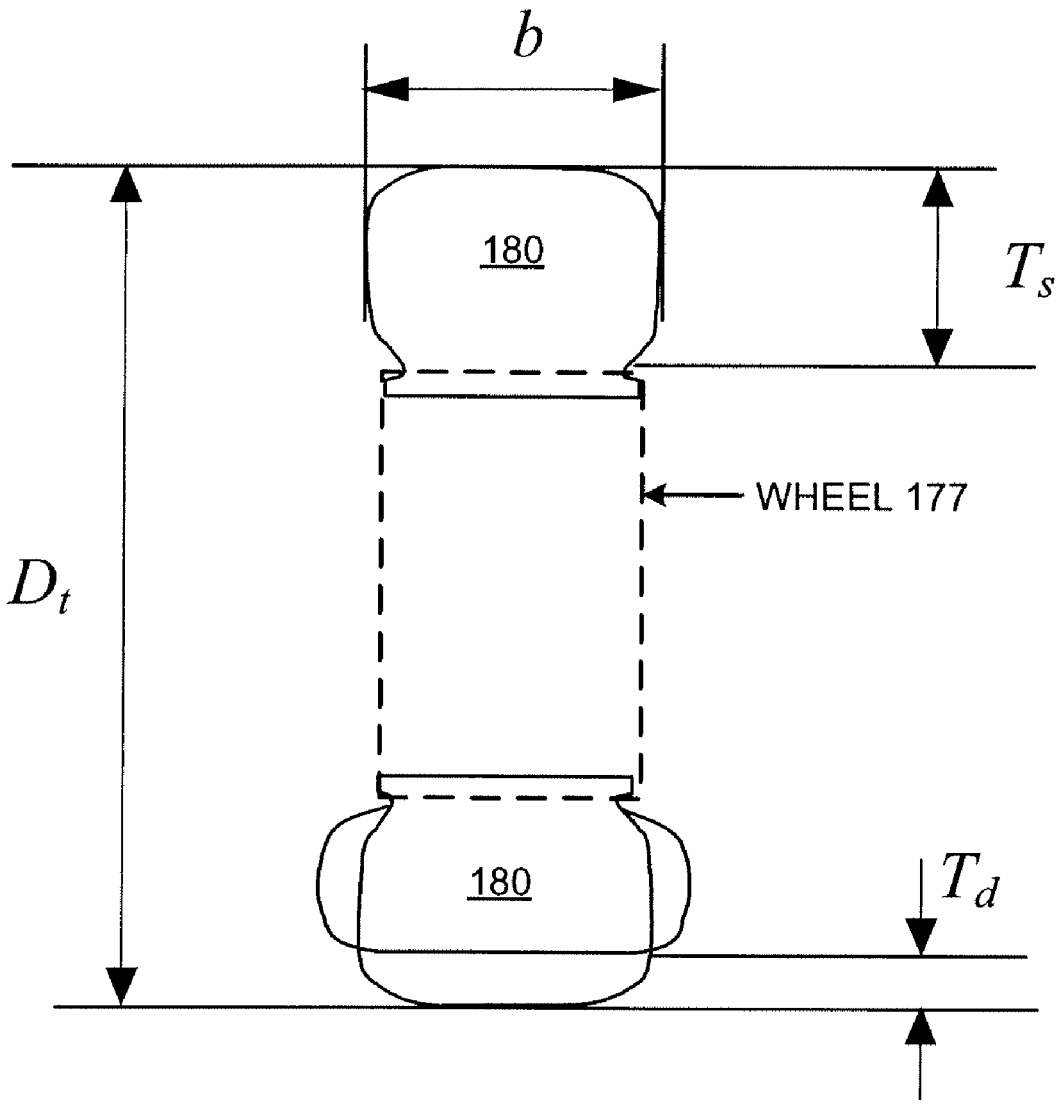
FIG. 9 is a diagram illustrating an example of tire deflection as a result of loading for a tire mounted on a wheel.
Figure 10:
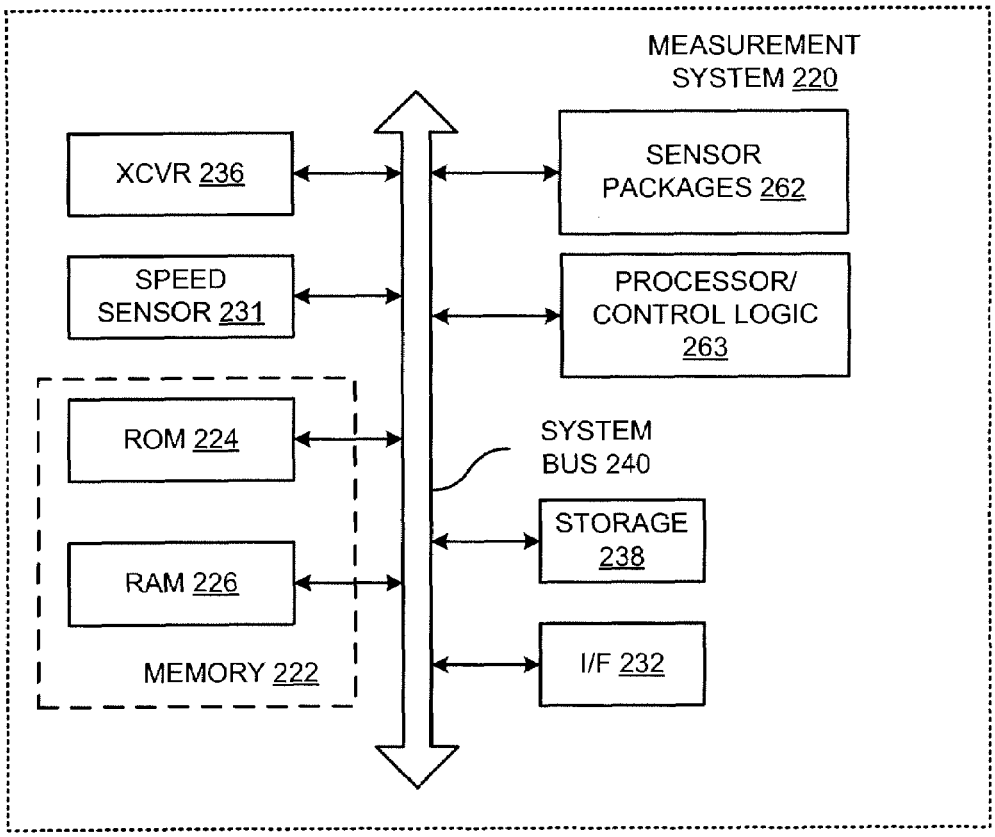
FIG. 10 is a diagram illustrating an example architecture for a measurement system in accordance with one embodiment of the invention.

FIG. 10 is a diagram illustrating an example architecture for a measurement system in accordance with one embodiment of the invention. After reading this description, it will become apparent to a person skilled in the relevant art how to implement the invention using other modules or architectures. Referring now to FIG. 9, the illustrated example measurement system 220 includes sensor packages 262, processing module 263, storage 238, communication interfaces 232, transceiver 236 and memory 222.

Computing module 263 might include, for example, one or more processors or processing devices, such as a processor, controller PLA, ASIC, DSP or other processing or computing device. In the example illustrated in FIG. 9, processor 263 is connected to a bus 240 or other communication medium to facilitate interaction with other components of measurement system 220. Processing, memory and other elements of measurement system 220 might be dedicated to the measurement process or might be shared with other processes or functions, whether or not related to soil strength measurement.

Measurement system 220 might also include one or more memory modules 222. For example, preferably random access memory 226 (RAM) or other dynamic memory, might be used for storing information and instructions to be executed by processing module 263. Main memory 222 might also be used for storing temporary variables or other intermediate information during execution of instructions to be executed by processing module 263. Measurement system 220 might likewise include a read only memory 224 ("ROM") or other static storage device coupled to bus 240 for storing static information and instructions for processing module 263.

The measurement system 220 might also include one or more various forms of information storage mechanism 238, which might include, for example, a media drive and a storage unit interface. Such storage might be used to store measurement results for the system. For example, raw measurement data, computed information, time stamps and other data can be stored for recording keeping, reporting, analysis or other purposes. The media drive might include a drive or other mechanism to support fixed or removable storage media. For example, a hard disk drive, a floppy disk drive, a magnetic tape drive, an optical disk drive, a CD or DVD drive (R or RW), or other removable or fixed media drive. Accordingly, storage media, might include, for example, a hard disk, a floppy disk, magnetic tape, cartridge, optical disk, a CD or DVD, or other fixed or removable medium that is read by, written to or accessed by media drive. As these examples illustrate, the storage media can include a computer usable storage medium having stored therein particular computer software or data.

In alternative embodiments, information storage mechanisms might include other similar instrumentalities for allowing computer programs or other instructions or data to be loaded into or from measurement system 220. Such instrumentalities might include, for example, a fixed or removable storage unit and an interface. Examples of such storage units and interfaces can include a program cartridge and cartridge interface, a removable memory (for example, a flash memory or other removable memory module) and memory slot, a PCMCIA slot and card, and other fixed or removable storage units and interfaces that allow software and data to be transferred to or from the storage unit to measurement system.

Measurement system 220 might also include a communications interface 232, 236. Communications interface 232, 236 might be used to allow software and data to be transferred between measurement system 220 and external devices. For example, Measurement data might be communicated to other vehicles in the area or in a convoy, to a collection site, or elsewhere.

Examples of communications interface 232, 236 might include a modem or softmodem, a network interface (such as an Ethernet, network interface card, WiMedia, 802.XX or other interface), a communications port (such as for example, a USB port, IR port, RS232 port Bluetooth interface, or other port), or other communications interface. Software and data transferred via communications interface 232, 236 might typically be carried on signals, which can be electronic, electromagnetic, optical or other signals capable of being exchanged by a given communications interface 232, 236. These signals might be provided to communications interface 232, 236 via a channel. This channel might carry signals and might be implemented using a wired or wireless medium. Some examples of a channel might include a phone line, a cellular link, an RF link, an optical link, a network interface, a local or wide area network, and other wired or wireless communications channels.

Figure 1:
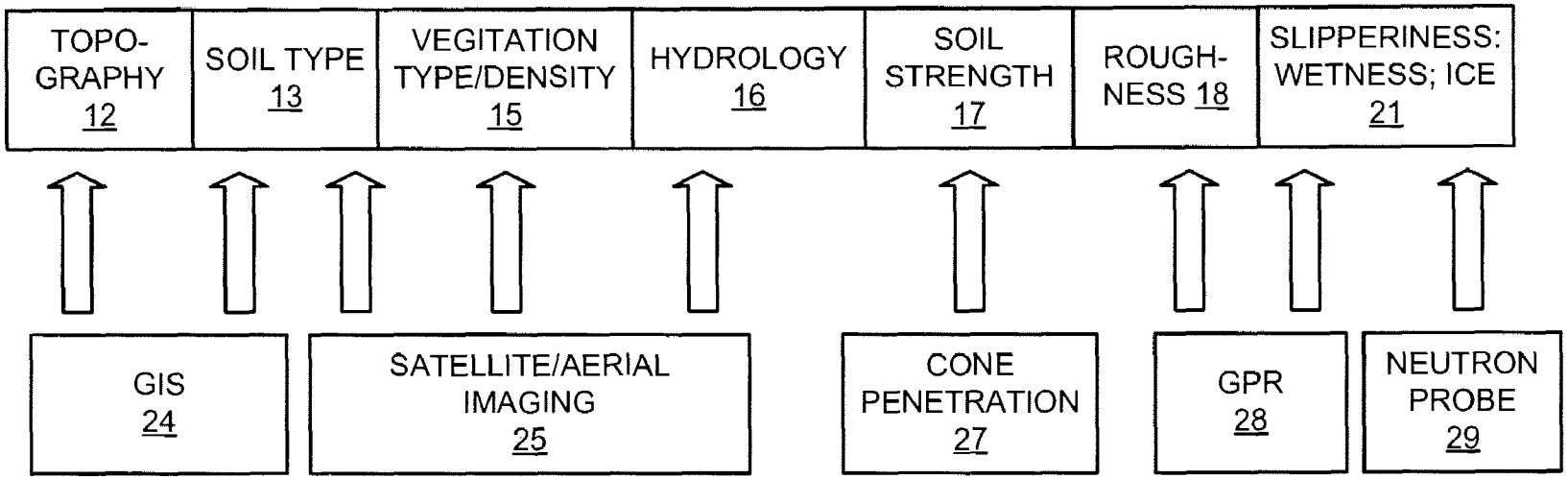
FIG. 1 is a diagram illustrating conventional measurement techniques for terrain factors measurement.

In one embodiment, measurement system can be a laptop, handheld or other PC based computer assembled with a multichannel data acquisition board to interface to the data sensors. Although not illustrated, a GPS receiver (for example, the Earthmate GPS LT-20 from Delorme) can be used to perform position determination. Accordingly, measurement data can be gathered, stored and tracked based on position, so that this data can be reused for subsequent travels through the same routes. A vegetation stress module can be included and interfaced to the computing system to allow information about vegetation to be gathered and stored. Other sensors can also be used to gather data such as the measurement tools and data described above with respect to FIG. 1. Vegetation data might be useful, for example, to allow additional information about the measurements to be gathered and stored. Vegetation information might be used, for example, to determine the validity of the soil measurement data received. For example, where vegetation exists, it may be difficult to obtain accurate distance measurements due to factors such as, for example, the presence of vegetation, variations in height of the vegetation, and so on. As another example, the tendency for vegetation to 'lie down' behind the wheel may potentially result in what appears to be a deeper track depth due to the flattened vegetation. Where operators are present in real-time, such observations could be manually observed and noted. However, for record-keeping and reporting purposes or for remote operation, such data could provide useful information as to the validity of the measurements.

In one embodiment, the system can be configured to operate in a Time Division Multiplexing Mode. The control unit communicates with sensors through the data bus. Track depth data readings occur according to a clock rate given by the CPU timer. Therefore, the output data stream is represented as a time series. Geographic locations of start and end points of each straight-line profile are defined with data from the GPS.

Although not illustrated, a graphical user interface can be provided to allow an operator (remote or in-vehicle) to control system operation. The interface can be configured to allow the operator to control input parameters and monitor the data acquisition process. Results can be recorded in a PC file in text or other format (for example, Microsoft Word® or Excel®) and can be used for subsequent processing.

Figure 11:
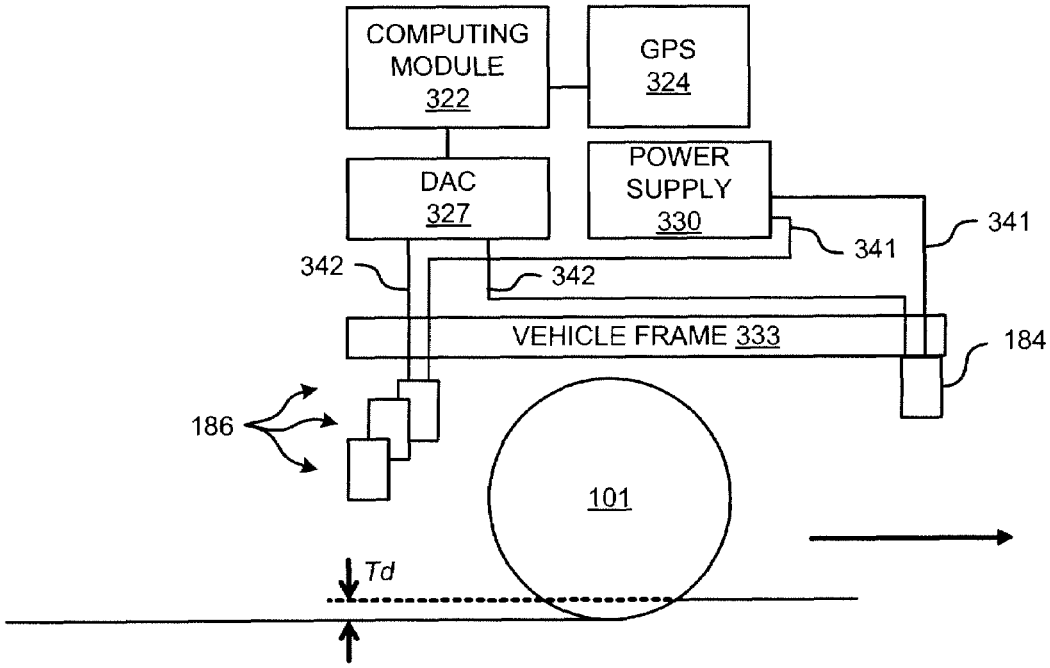
FIG. 11 is a diagram illustrating another example architecture for a measurement system in accordance with one embodiment of the invention.

FIG. 11 is a diagram illustrating another example architecture for a measurement system in accordance with another embodiment of the invention. This example architecture includes a computing module 322, a GPS system 324, digital-to-analog converters 327, and a power supply 330. Also illustrated are a front sensor 184 and rear sensors 186 mounted to a vehicle frame 333. This is illustrated with respect to a wheel 101 moving in a direction of travel indicated by the arrow. In this example architecture, power supply 330 provides power to sensors 184 and 186 via supply lines 341. Although not illustrated, power supply 330 also supplies power to other components of the system. Sensors 184 and 186 measure the distance between the vehicle and the soil. The measurements are passed via data lines 342 such that they can be analyzed by computing module 322. In the illustrated embodiment, sensors provide an analog signal. Accordingly, digital to analog converter 327 digitizes the signal before passing it along to computing module 322. GPS 324 is used to allow locational information to be logged with the measurement information such that the measurements can be correlated with spatial locations.

FIG. 12 shows an example of a fragment of data file in accordance with one embodiment of the invention. The system can be implemented to build transverse profiles along a rear sensor array, which is a characteristic of vehicle impact on terrain and to draw a semivariogram plot along profiles for sensors. A Semivariogram can be used for characterization of soil surface roughness. It depends on the direction in which it is evaluated and therefore, semivariograms obtained in orthogonal directions can characterize spatial anisotropy of surface roughness. This can be an important environmental parameter affecting dynamics of precipitation runoff. Semivariograms can be derived and plots for soil surface profile can be obtained using data from sensors and the information can also be displayed to users.

In this document, the terms "computer program medium" and "computer usable medium" are used to generally refer to media such as, for example, memory, storage unit, media, and signals on a channel. These and other various forms of computer program media or computer usable media may be involved in carrying one or more sequences of one or more instructions to a processing device for execution. Such instructions embodied on the medium, are generally referred to as "computer program code" or a "computer program product" (which may be grouped in the form of computer programs or other groupings). When executed, such instructions might enable the measurement system 220 to perform features or functions of the present invention as discussed herein.

The term tool can be used to refer to any apparatus configured to perform a recited function. For example, tools can include a collection of one or more modules and can also be comprised of hardware, software or a combination thereof. Thus, for example, a tool can be a collection of one or more software modules, hardware modules, software/hardware modules or any combination or permutation thereof. As another example, a tool can be a computing device or other appliance on which software runs or in which hardware is implemented.

As used herein, the term module might describe a given unit of functionality that can be performed in accordance with one or more embodiments of the present invention. As used herein, a module might be implemented utilizing any form of hardware, software, or a combination thereof. For example, one or more processors, controllers, ASICs, PLAs, logical components, software routines or other mechanisms might be implemented to make up a module. In implementation, the various modules described herein might be implemented as discrete modules or the functions and features described can be shared in part or in total among one or more modules. In other words, as would be apparent to one of ordinary skill in the art after reading this description, the various features and functionality described herein may be implemented in any given application and can be implemented in one or more separate or shared modules in various combinations and permutations. Even though various features or elements of functionality may be individually described or claimed as separate modules, one of ordinary skill in the art will understand that these features and functionality can be shared among one or more common software and hardware elements, and such description shall not require or imply that separate hardware or software components are used to implement such features or functionality.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

The invention claimed is:

1. A method of characterizing soil shear strength from a vehicle, comprising:

measuring a first distance between a first sensor mounted to the vehicle and the soil;

measuring a second distance between a second sensor mounted to the vehicle and a track made in the soil by the vehicle;

calculating track depth as a function of the first and second distance measurements;

deriving soil shear strength as a function of the calculated track depth and vehicle parameters.

2. The method of claim 1, wherein track depth is calculated as a difference between the first and second distances.

3. The method of claim 1, wherein the first sensor is mounted to the vehicle in a position in front of a vehicle wheel to thereby measure the distance to a location on the ground before that location is traveled on by the wheel when the vehicle is moving, and the second sensor is mounted to the vehicle in a position behind the vehicle wheel to thereby measure the distance to a point in a track made by the wheel after it has traveled over that point on the ground.

4. The method of claim 1, wherein the first and second sensors comprise a plurality of sensors arranged in an array behind the wheel.

5. The method of claim 1, further comprising determining which sensors of a plurality of sensors are used to measure the first and second distances.

6. The method of claim 1, wherein measuring the first distance comprises measuring distances from a plurality of sensors and determining the first distance as a function of the plurality of distance measurements.

7. The method of claim 6, determining the first distance as a function of the plurality of distance measurements comprises averaging the plurality of distance measurements or comparing the distance measurements and discarding an outlier data point.

8. The method of claim 1, further comprising determining which of a plurality of sensors to use as the second sensor to measure distance to the track.

9. The method of claim 8, wherein determining which of a plurality of sensors to use as the second sensor comprises selecting from the plurality of sensors the sensor that indicates the greatest distance measurement.

10. The method of claim 8, wherein determining which of a plurality of sensors to use as the second sensor comprises selecting a sensor based on wheel angle or evaluating measurements from a plurality of sensors and selecting the sensor showing the greatest measured distance.

11. The method of claim 1, wherein the track depth is determined as $$h_{t2}=D_{S2t2}-D_{S1t1}\pm\Delta$$

wherein, $D_{S2t2}$ is the distance measured by the second sensor at a time t2, and $D_{S2t1}$ is the distance measured by first sensor at a time t1, and wherein Δ is an offset between the first and second sensors, if any.

12. The method of claim 11, wherein time t2 and time t1 are the same point in time.

13. The method of claim 11, wherein time t2 is delayed from time t1 by an amount of time it takes for the second sensor to reach a point where it is measuring the same location on the ground as that measured by the first sensor.

14. The method of claim 1, wherein deriving soil shear strength as a function of the calculated track depth and vehicle parameters comprises calculating a Rated Cone Index for clay terrain numeric or penetration resistance gradient for sand terrain.

15. A system for characterizing soil shear strength from a vehicle, comprising:

a plurality of sensors comprising a first sensor disposed on the vehicle and configured to measuring a first distance between the first sensor and the soil and a second sensor disposed on the vehicle and configure to measure a second distance between a the sensor and a track made in the soil by the vehicle;

a processing module communicatively coupled to the sensors;

computer program product embodied on a computer usable medium, the computer program product comprising computer program code configured to enable the processing module to perform the operations of; calculating track depth as a function of the first and second distance measurements; and deriving soil shear strength as a function of the calculated track depth and vehicle parameters.

16. The system of claim 15, wherein the track depth is calculated as a difference between the first and second distances.

17. The system of claim 15, wherein the first sensor is mounted to the vehicle in a position in front of a vehicle wheel to thereby measure the distance to a location on the ground before that location is traveled on by the wheel when the vehicle is moving, and the second sensor is mounted to the vehicle in a position behind the vehicle wheel to thereby measure the distance to a point in a track made by the wheel after it has traveled over that point on the ground.

18. The system of claim 15, wherein the first and second sensors comprise a plurality of sensors arranged in an array behind the wheel.

19. The system of claim 15, wherein the array is arranged normal to or approximately normal to the direction of travel of the vehicle.

20. The system of claim 15, wherein the computer program code configured to enable the processing module to perform the operation of determining which sensors of a plurality of sensors are used to measure the first and second distances.

21. The system of claim 15, wherein the operation of measuring the first distance comprises measuring distances from a plurality of sensors and determining the first distance as a function of the plurality of distance measurements.

22. The system of claim 21, wherein determining the first distance as a function of the plurality of distance measurements comprises averaging the plurality of distance measurements or comparing the distance measurements and discarding an outlier data point.

23. The system of claim 15 wherein the computer program code configured to enable the processing module to perform the operation of determining which of a plurality of sensors to use as the second sensor to measure distance to the track.

24. The system of claim 23, wherein determining which of a plurality of sensors to use as the second sensor comprises selecting from the plurality of sensors the sensor that indicates the greatest distance measurement.

25. The system of claim 23, wherein determining which of a plurality of sensors to use as the second sensor comprises selecting a sensor based on wheel angle or evaluating measurements from a plurality of sensors and selecting the sensor showing the greatest measured distance.

26. The system of claim 15, wherein the track depth is determined as $$h_{t2}=D_{S2t2}-D_{S1t1}\pm\Delta$$

wherein, $D_{S2t2}$ is the distance measured by the second sensor at a time t2, and $D_{S2t1}$ is the distance measured by first sensor at a time t1, and wherein Δ is an offset between the first and second sensors, if any.

27. The system of claim 26, wherein time t2 and time t1 are the same point in time.

28. The system of claim 26, wherein time t2 is delayed from time t1 by an amount of time it takes for the second sensor to reach a point where it is measuring the same location on the ground as that measured by the first sensor.

29. The system of claim 15, wherein the sensors comprise remote or contactless sensors.

30. The system of claim 29, wherein the sensors comprise optical or UWB sensors.

31. The system of claim 15, wherein the sensors comprise optical sensors.

32. The system of claim 15, wherein deriving soil shear strength as a function of the calculated track depth and vehicle parameters comprises calculating a Rated Cone Index for clay terrain numeric or penetration resistance gradient for sand terrain.

* * * * *